United States Patent [19]

Natarajan et al.

[11] 4,388,066

[45] Jun. 14, 1983

[54] RADIATION SHIELD AND METHOD OF USE

[75] Inventors: Cuddalore P. Natarajan; Siegfried R. Meder, both of Pittsburgh, Pa.

[73] Assignee: American Schack Company, Inc., Wexford, Pa.

[21] Appl. No.: 289,100

[22] Filed: Jul. 31, 1981

[51] Int. Cl.[3] ..... F27D 7/00; F24J 3/00; F22B 7/04

[52] U.S. Cl. ..... 432/1; 122/155 A; 122/169; 432/65; 432/226

[58] Field of Search ..... 432/1, 65, 226; 122/14, 122/16, 7 C, 155 A, 169, 160, 161, 248, DIG. 13; 165/161; 126/366

[56] References Cited

U.S. PATENT DOCUMENTS

| | | | |
|---|---|---|---|
| 1,647,570 | 11/1927 | Kling | 122/DIG. 13 |
| 2,009,852 | 7/1935 | Lum et al. | 122/161 |
| 2,904,014 | 9/1959 | Meyers | 122/169 |
| 3,238,667 | 3/1966 | Remmert | 122/248 |

FOREIGN PATENT DOCUMENTS

| | | | |
|---|---|---|---|
| 466359 | 5/1937 | United Kingdom | 122/14 |

*Primary Examiner*—John J. Camby

*Attorney, Agent, or Firm*—Stanley J. Price, Jr.; John M. Adams

[57] ABSTRACT

A coiled arrangement of pipes convey a heated medium, such as a slurry, into, through, and out of a heater or fire box provided with an arrangement of high velocity burners. The heater is fired to a preselected elevated temperature. A plurality of radiation shields are positioned in close proximity to the surfaces of the pipes conveying the medium for heating. The position of the radiation shields relative to the pipes forms inner and outer heating zones within the heater to provide different flame temperatures. The radiation shields function as a physical barrier to prevent direct contact of the fuel flame and combustion products with the pipes. Thus the radiation shields are maintained at a higher temperature than the surfaces of the pipes and at a lower temperature than the combustion products. The radiation shields limit the flame radiation to the pipes and thereby reduce the rate of heat transfer to the medium permitting the use of high flame radiating temperatures in the heater so that a relatively low rate of heat transfer is obtainable inside a fire box, without unduly reducing the fire box temperature.

19 Claims, 2 Drawing Figures

RADIATION SHIELD AND METHOD OF USE

BACKGROUND OF THE INVENTION

1. Field of the Invention

This invention relates to a radiation shield for pipes conveying a medium through a heater and more particularly to method and apparatus for controlling the rate of transfer to heating surfaces by radiation shields positioned in close proximity to an arrangement of pipes through which a medium flows and is maintained separate from the products of combustion.

2. Description of the Prior Art

It is known in conventional preheaters or radiation recuperators to convey hot flue gas through a flue chamber in heat transfer relation to a medium, such as air, to be heated. The medium to be heated in one arrangement flows through heating passages which are heated by the radiant heat from the flue gas passing through the flue chamber.

In another arrangement the medium to be heated is directed through an additional passageway which is heated by the flue gas at a point distant from the flue chamber. Accordingly, the capacity of the preheater or recuperator to heat the medium is increased by additional heat transfer sections.

In a shell-type combustion furnace recuperator a vertical inner liner receives flue gas exhausted from a furnace. An intermediate liner surrounds the inner liner to form an air heating passageway therethrough. An inlet box supplies hot flue gas to one end of the passage. A discharge means receives the waste flue gas from the other end of the passage. An outer metal support shell having a refractory lining surrounds both the inner and intermediate liners.

In certain preheater operations, it is necessary to limit the heat transfer to two or more widely different rates, for example, 12,000 BTU/Ft$^2$Hr for a certain of the fire box and 7,500 BTU/Ft$^2$Hr for another section of the fire box. Different heat transfer rates as above require different flame radiating temperatures. Because the above heat transfer rates are relatively low, low flame radiating temperatures are required, particularly if the heating passages or pipes are exposed to direct flame radiation. Low flame radiating temperatures require large volumes of flue gas recirculation with fuel fill firing or low fuel firing without any gas recirculation. Low fuel firing in large fire boxes results in poor mixing, considerable thermal gradients in the flue gas, and heat transfer variation in the pipes.

There is a need in fired heaters and the like to control the heat transfer rate to the radiant section heating surfaces while permitting the use of relatively high flame radiating temperature as opposed to relatively low flame radiating temperatures.

SUMMARY OF THE INVENTION

In accordance with the present invention there is provided in a heater the combination that includes a heating chamber fired to a preselected temperature. The heating chamber has a wall with an inlet and an outlet extending therethrough. Conduit means positioned in a preselected arrangement within the heating chamber conveys a medium from the inlet through the heating chamber to the outlet. A radiation shield is positioned adjacent the conduit means within the heating chamber. The radiation shield is supported in the heating chamber in spaced relation to the conduit means. The radiation shield forms a heat transfer barrier between the source of heat in the heating chamber and the conduit means to reduce the heat transferred to the conduit means for heating the medium.

Preferably, the conduit means includes a coiled pipe section connected to the inlet and outlet for conveying the medium through the heater. The coiled pipe section is formed by a plurality of connected helical pipe coils positioned horizontally in overlying spaced relation. An inner heating zone is provided within the coiled pipe section and an outer heating zone is provided outside the coiled pipe section. A first set of burners supplies heat to the inner heating zone, and a second set of burners supplies heat to the outer heating zone.

The radiation shield includes a plurality of plate members fabricated of either metal, ceramic material, or a combination of both. The plate members are positioned in the inner and outer heating zones in close proximity to the pipe coils. The plate members in the inner heating zone are positioned between the first burner means and the inside of the coiled pipe section. The radiation plates are also positioned in the outer heating zone between the second burner means and the outside of the coiled pipe section. With this arrangement the radiation plates function as physical barriers between the products of combustion in the heating chamber and the coiled pipes. The radiation plates substantially shield the pipes from direct contact with the radiant heat from the burners. Thus the heat transferred to the pipes is substantially lessened to control the heating of the medium in the pipes.

Further, in accordance with the present invention, there is provided a method of reducing the heat transfer to a medium in a heater that includes the steps of heating a chamber of the heater to a preselected temperature. A medium is conveyed through conduit means in the chamber for heating. The medium for heating is maintained separated from the products of combustion in the chamber. The conduit means is shielded from direct contact with the products of combustion. The heat thus transferred from the products of combustion to the conduit means and the medium is reduced to a preselected level of heat transfer.

Accordingly, the principal object of the present invention is to provide a fired heater for controlled heating of a medium conveyed through conduits in the heater with different radiating temperatures around the conduits.

Another object of the present invention is to provide a radiation shield for reducing the rate of heat transfer from the products of combustion in a heater to a medium conveyed through conduits to be heated in the chamber.

A further object of the present invention is to provide a method of limiting flame radiation upon pipes conveying a medium for heating in a chamber of a heater.

An additional object of the present invention is to permit the use of higher fire box temperatures in a heater to heat a medium flowing through pipes heated in the fire box so that optimum mixing of the combustion products in the fire box is obtained and the thermal gradients in the combustion products is minimized.

Another object of the present invention is to provide radiation shields in surrounding relation with pipes for conveying a medium through the heating chamber of a fire box so that the flame radiation to the pipes is limited and the heat transfer to the pipes is reduced for relatively high flame radiating temperatures.

These and other objects of the present invention will be more completely disclosed and described in the following specification, the accompanying drawings, and the appended claims.

DESCRIPTION OF THE PREFERRED EMBODIMENT

Figure 1:
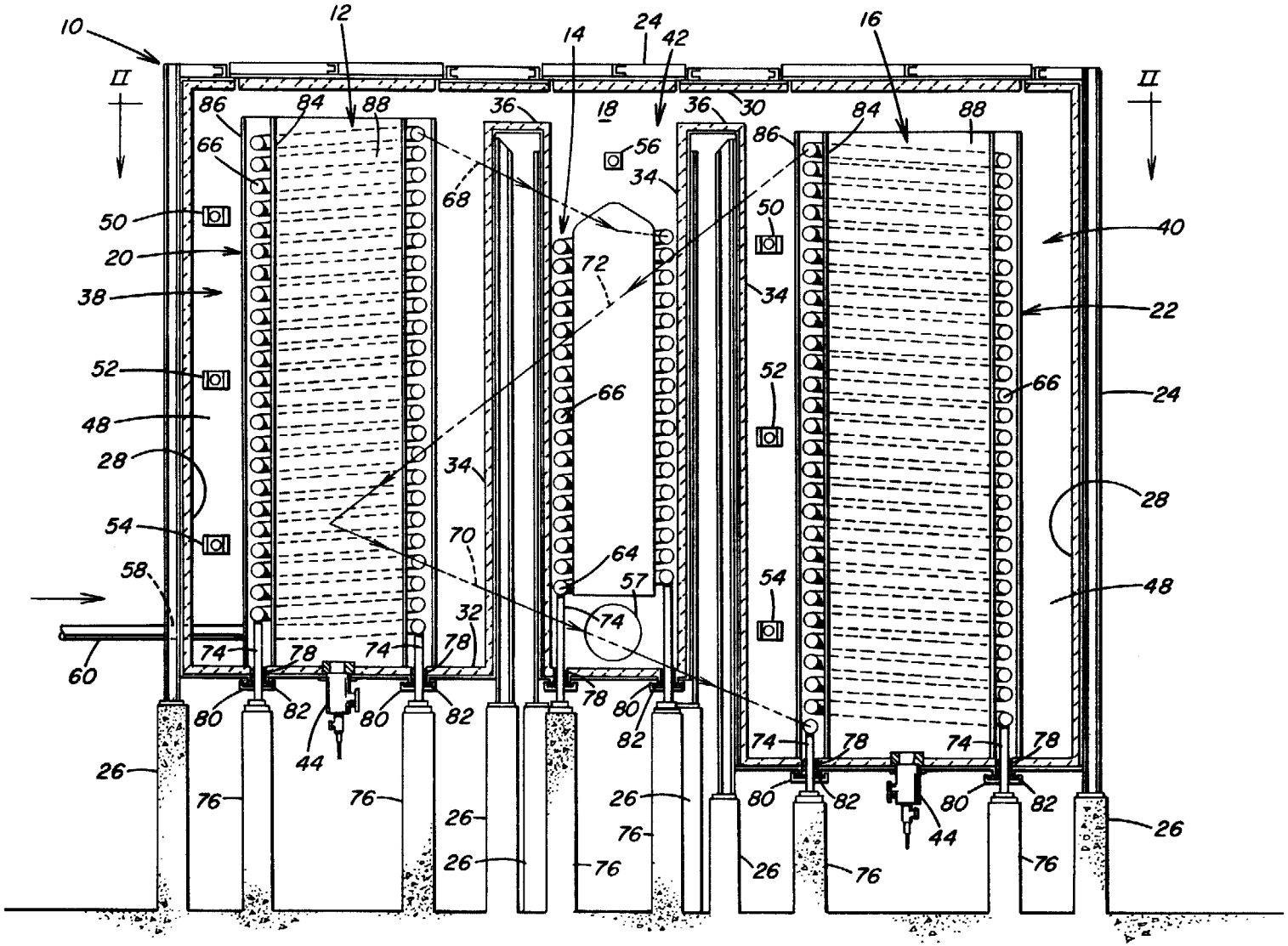
FIG. 1 is a sectional view in side elevation of a heater for heating a medium conveyed through a plurality of coiled pipe sections, illustrating radiation shields positioned between the coiled pipe sections and the burners in the heating chamber for reducing the heat transfer to the medium in the coiled pipe sections.

Referring to the drawings and particularly to FIG. 1, there is illustrated a heater generally designated by the numeral 10 for heating a medium conveyed by a plurality of coiled pipe sections generally designated by the numerals 12, 14, and 16 through a heating chamber 18 of the heater 10. The heating chamber 10 is heated to a preselected flame temperature in a manner to be discussed later in greater detail. The flame radiation generated by the combustion products in the heating chamber 18 to the coiled pipe sections 12 and 16 is controlled by a plurality of radiation shields 20 and 22 respectively.

The radiation shields 20 and 22 are positioned between the source of the flame radiation in the heating chamber 18 and the coiled pipe sections 12 and 16. The radiation shields 20 and 22 are positioned to form a physical barrier between the source of heat and the coiled pipe sections 12 and 16 to reduce the heat transferred to the coiled pipe sections 12 and 16 for heating a medium, such as a coal slurry conveyed through the coiled pipe sections 12, 14 and 16 into, through and out of the heater 10. Also, as will be explained later in greater detail this arrangement permits the use of a higher flame radiating temperature in the heater and minimizes the thermal gradients of the combustion products in the heater and variations in the radiant heat transferred to the coiled pipe sections 12 and 16.

The heater or fire box 10 includes an outer housing 24 constructed of preferably carbon steel plates. The housing is supported by concrete support columns 26 above ground level. The housing is lined with a suitable refractory material, such as refractory brick, or ceramic fibers to form the interior walls 28, roof 20 and floor 32 of the refractory heating chamber 18. The heating chamber 18 is divided into a plurality of individual heating chambers 38, 40 and 42 by the inclusion of inner refractory walls 34 which are also supported by columns 26 and surrounded by a housing also formed by steel plates.

The inner walls extend upwardly from the floor 32 and are spaced from the roof 30. Preferably with this arrangement the heating chamber 18 is divided into a pair of radiant heating chambers 38 and 40 separated from each other by a convective heating chamber 42. The inner walls 34 forming the convective heating chamber 42 segregate the radiant heating chambers 38 and 40 from each other. It should be understood that the heating chamber 18 can be subdivided into any number of individual heating chambers each containing a coiled pipe section or a single heating chamber can be utilized with a single coiled pipe section and a corresponding radiation shield in accordance with the present invention.

Figure 2:
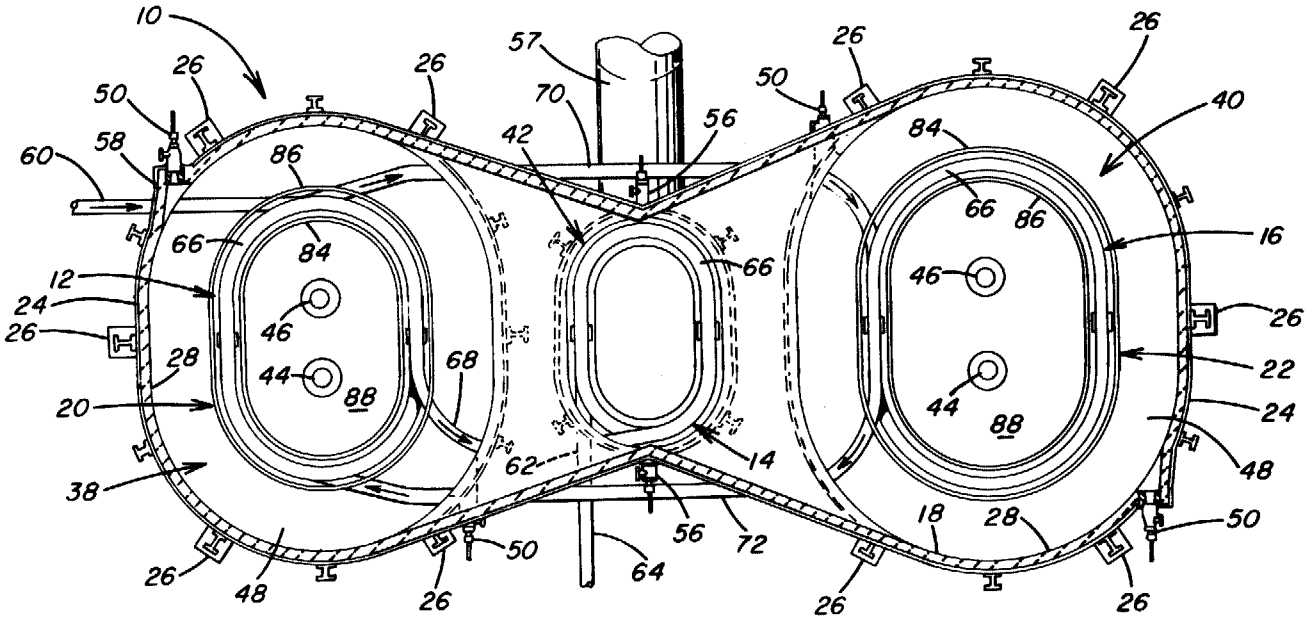
FIG. 2 is a top plan sectional view of the heater shown in FIG. 1 taken along line II—II of FIG. 1.

Each of the radiant heating chambers 38 and 40 is provided with a pair of high velocity forced draft burners 44 and 46, as illustrated in FIG. 2. The burners 44 and 46 are positioned in the floor 32 of the radiant heating chambers 38 and 40. The burners 44 and 46 project flame and combustion products into the radiant heating chambers 38 and 40. The radiation shields 20 and 22 form with the walls 28 of the radiant heating chambers 38 and 40 annular spaces 38. These annular spaces 48 also form outer heating zones as will be explained later in greater detail.

Projecting into the annular spaces 48 are a plurality of additional high velocity burners. Each of the radiant heating chambers 38 and 40 includes three levels of a pair of burners 50, 52, and 54. As noted in FIG. 2 the refractory walls 28 of the radiant heating chambers have arcuate portions. The respective pairs of burners 50, 52, and 54 are positioned on the walls 28 to fire tangentially into the radiant heating chambers 38 and 40. This arrangement generates a cork screw type of flow of combustion products in the radiant heating chambers 38 and 40. Consequently the products of combustion uniformly mix in the radiant heating chambers 38 and 40 resulting in uniform heating of the coiled pipe sections 12 and 16.

FIG. 2 illustrates the location of the first pair of burners 50 positioned diagonally opposed at the same elevation in the radiant heating chambers 38 and 40. The pair of burners 50 are positioned at a preselected elevation above the floor 30. Correspondingly, the burner pairs 52 and 54 are positioned beneath the burner pair 50 so that the burner pairs 50, 52, and 54 are spaced a preselected distance apart. The convective heating chamber 42 may also include a selected number of pairs of high velocity burners 56 spaced vertically in the walls 34 of the convection heating chamber 42. The products of combustion are exhausted from the chamber 18 through a flue 57.

Preferably a medium, such as a coal slurry, is conveyed through the conduit system that includes the coiled pipe sections 12, 14, and 16. Preferably for a medium temperature of 460° F. a heat transfer rate of 12,000 BTU/Ft$^2$Hr. is desired and for a medium temperature in the range 510° to 640° F. a heat transfer rate of 7,500 BTU/Ft$^2$Hr. is desired in order to heat the medium to a preselected temperature when it is conveyed out of the heater 10. The above range of heat transfer rates is comparatively low thereby requiring very low flame radiating temperatures when the conduit system is exposed to direct flame radiation. However, when low flame temperatures are used large volumns of flue gas recirculation with full fuel firing or low fuel firing without flue gas recirculation is required.

The radiation shields 20 and 22 utilized in accordance with the present invention limit or provide resistance to the flame radiation directed to the coiled pipes of the radiation sections 12 and 16. By the use of the radiation shields 20 and 22 higher flame radiating temperatures can be used because the radiation shields attenuate the head transfer to the surfaces of the coiled pipe sections 12 and 16. This arrangement substantially eliminates the problems associated with low flame temperatures in large fire boxes. The use of the radiation shields 20 and 22 with the coiled pipe sections 12 and 16 results in uniform mixing of the combustion products throughout the radiant heating chambers 38 and 40 with a minimal thermal gradient throughout the heating chambers 38 and 40.

The heater 10, as illustrated in FIG. 2, includes an inlet 58 through which a straight pipe section 60 extends through the wall 28 and an outlet 62 through which a straight pipe section 64 extends out of the heating chamber 18. The medium to be heated, such as a coal slurry, is conveyed through the straight pipe section 60 into the heating chamber 18. While in the heater 10, the temperature of the medium is raised by radiant heat transferred to the surfaces of the coiled pipe sections 12, 14 and 16 and by convective heat transferred from the coiled pipe sections 12, 14 and 16 to the medium engaging the inner walls of the pipe sections.

Preferably, each of the pipe sections 12, 14, and 16 includes a plurality of helical coils 66 positioned horizontally and in overlying spaced relation in a vertical array. The helical coils 66 of each section 12, 14, and 16 are connected by welding so that the medium flows continuously through each section. In addition, the respective sections 12, 14 and 16 are connected to one another as schematically illustrated in FIG. 1 to provide a continuous flow from the inlet 58 through the radiant pipe sections 12 and 16 and the convective pipe section 14 and out the pipe section 64 of the convective pipe section 14.

Preferably, the respective coiled pipe sections 12, 14, and 16 are connected by straight and arcuate sections of pipe in a manner to be explained later in greater detail. As illustrated in FIG. 2, the coiled pipe sections 12, 14, and 16 are eliptical in shape and each having a different circumferential length for each of the respective helical coils 66 comprising the respective coiled pipe sections, 12, 14, and 16. Also the height of the coiled pipe sections is selective. In addition for the sections 12 and 16 having bottom burners the height to diameter ratio of the heating zone is preferably within a preselected range in order to obtain a uniform temperature in the respective heating zone. For example, the individual helical coils 66 of the radiant pipe section 16 have a greater circumferential length than the helical coils 66 of the radiant pipe section 12. The circumferential length of the individual helical coils 66 of the convective pipe section 14 is less than that for the helical coils 66 of both pipe sections 12 and 16. Preferably, the coiled pipe sections 12, 14 and 16 are connected and arranged in this manner to reduce the unheated portions of the coiled pipe sections and the pipes connecting the respective pipe sections 12, 14 and 16.

The straight pipe section 60 from the heating chamber inlet 58 is connected to the lowermost helical coil 66 of the radiant pipe section 12 as seen in FIG. 1. The uppermost helical coil 66 of the radiant pipe section 12 is connected by welding an arcuate or bent pipe section 68 to the uppermost helical coil 66 of the conductive pipe section 14. The pipe section 68 is schematically illustrated in FIG. 1. The medium flows from the radiant pipe section 12 through the pipe section 68 to the conductive pipe section 14. The medium then flows through the helical coils 66 of the conductive pipe section 14 to the pipe section 64 and out of the heating chamber 18. The medium exits the heating chamber 18 at a preselected elevated temperature above the temperature of the medium entering the heating chamber 18.

A selected intermediate coil 66 of the radiant pipe section 12 is connected by a substantially straight pipe section 70 (schematically illustrated in FIG. 1) to the lowermost helical coil 66 of the other radiant pipe section 16. Thus the medium to be heated is diverted by the pipe section 70 from the radiant pipe section 12 to the radiant pipe section 16. The medium flows through the helical coils 66 of the radiant pipe section 16 which is heated by the combustion products within the radiant heating chamber 40. The medium is conveyed from the radiant heating chamber 40 through a second substantially straight pipe section 72 (schematically illustrated in FIG. 1) back to a selected intermediate coil 66 of the radiant pipe section 16. The straight pipe section 72, similar to the straight pipe section 70, passes out of the heating chamber 18 and then back into the heating chamber 18 for connection to a selected one of the helical coils 66 of the radiant pipe section 12 in the radiant heating chamber 38. The medium then flows through the radiant pipe section 12 to the convective pipe section 14 as above described.

With the above arrangement, the medium to be heated is circulated through the various coiled pipe sections 12, 14 and 16, and is heated by the combustion products introduced into the heating chamber 18 by the burners 44, 46, 50, 52, 54 and 56. During the heating of the medium, the radiation shields 20 and 22 associated with the coiled pipe sections 12 and 16 in the radiant heating chambers 38 and 40 reduce or lessen the heat transferred from the combustion products to the medium. The radiation shields 20 and 22 function as barriers to substantially prevent direct contact of the flame radiation with the surface of the respective helical coils 66.

As illustrated in FIG. 1, a plurality of support castings 74 transmit the load of the respective coiled pipe sections 12, 14 and 16 to a plurality of support columns 76 positioned beneath the heater floor 32. The support castings 74 penetrate through openings 78 in the heater floor 32. Positioned around the support castings 74 beneath the floor 32 are U-shaped plates 80 that extent upwardly in surrounding relation with the support castings 74. Preferably the openings 78 are sealed by sand 82 which is retained by the U-shaped plates 80 within the openings 78. The sand seal serves to reduce the infiltration of ambient air into the heater 10. The support castings 74 extend between the lowermost helical coils 66 of the respective coiled pipe sections 12, 14 and 16 and the support columns 76. The support castings 74 can be mounted on the columns 76 in a manner to fixedly support the coiled pipe sections 12, 14, and 16 or movably support the coiled pipe sections 12, 14, and 16.

Preferably each of the radiation shields 20 and 22 associated with the coiled pipe sections 12 and 16 of the radiant heating chambers 38 and 40 is formed by a pair of spaced apart circular shield plates 84 and 86. The circular shield plates 84 and 86 are dimensioned to correspond to the respective circumference of the coiled pipe sections 12 and 16. It should be understood that the construction of the radiation shields 20 and 22 including the shield plates 84 and 86 is the same. The construction of the radiation shield 20 for the radiant pipe section 12 will be explained in detail and the same construction is applicable to the radiation shield 22 for the radiant pipe section 16.

For the radiant pipe section 12 the shield plates 84 and 86 are positioned on the heating chamber floor 32 on both sides of the helical coils 66. The shield plates 84 and 86 are positioned closely to the helical coils 66 but are removed from contact therewith. With this arrangement the inner shield plate 84 is positioned inside the helical coils 66 between the burners 44, 46 and the floor 32. With this arrangement the shield plate 84 defines an inner heating zone 88. The coils 66 are thus removed from direct contact with the flame radiation from the burners 44 and 46. The inside of the coils 66 are subjected, however, to the radiation reflected by the refractory roof 30 and floor 32 of the heating chamber 18.

Similarly, the shield plate 86 is positioned on the outside of the helical coils 66 in close proximity with the helical coils 66. The shield plate 86 and the refractory walls 28 from an annular space 48. The vertically spaced pairs of burners 50, 52, and 54 form an outer heating zone in the annular space 48. Each pair of burners 50, 52, and 54 fire tangentially into the radiant heating chamber 38 to provide an optimum mix of combustion products in surrounding relation with the radiant pipe section 12. The shield plate 86 serves as a physical barrier in the outer heating zone 48 to resist the high flame radiating temperatures from the burners 50, 52 and 54. The radiation shields 20 and 22 can be fabricated of any metal, for example stainless steel, ceramic material, or a combination of both. In addition, the radiation shields 20 and 22 can be provided with small holes or other material attached to the radiation shields to modify the thermal characteristics of the shields. When necessary multiple shields can be used.

By providing the two heating zones, i.e., the inner heating zone 88 and the outer heating zone 48, two different firing rates are obtained for heating the radiant heating section 12. In the outer heating zone 48, the refractory walls 28 present a large re-radiation surface. The outer shield plate 86 introduces additional resistance to the radiant heat flow from the products of combustion in the radiant heating chamber 38 to the medium in the pipe coils 66. In view of the fact that re-radiation from the reflectory walls 28, roof 30 and floor 32 differs for both the inner heating zone 88 and the outer heating zone 48, the gas temperatures in the inner and outer heating zones are different.

The total effect of the shield plates 84 and 86 in the inner and outer heating zones 48 and 88 is to introduce resistance in the radiant heating chambers 38 and 40 to radiant heat flow to the medium. With the provision of the radiation shields 20 and 22 it is now possible to use higher fire box temperatures. This avoids the need for reduced fuel input or gas recirculation with full fuel input in order to obtain the desired low heat transfer rates. Thus the problem of a poorly mixed fire box having large thermal gradients in the flue gas and flux variations in the pipes associated with low flame radiating temperatures is overcome. With the radiation shields 20 and 22 of the present invention, the coiled pipe sections 12 and 16 are shielded from direct contact with the radiant heat from the burners 44, 46, 50, 52, and 54. As a result, higher fire box temperatures can be utilized in the heating chamber 18 for a more efficient operation of the heater 10.

According to the provisions of the patent statutes, we have explained the principle, preferred construction, and mode of operation of our invention and have illustrated and described what we now consider to represent its best embodiments. However, it should be understood that, within the scope of the appended claims, the invention may be practiced otherwise than as specifically illustrated and described.

We claim:

1. In a heater, the combination comprising, a heating chamber including inner and outer heating zones, each of said heating zones being separately fired to a preselected temperature, said heating chamber having a wall with an inlet and an outlet extending therethrough, conduit means positioned in a preselected arrangement within said heating chamber for conveying a medium from said inlet through said heating chamber to said outlet, said conduit means includes a first pipe section connected to said inlet and a second pipe section connected to said outlet, a coiled pipe section connecting said first pipe section to said second pipe section, said coiled pipe section forming said inner heating zone and said outer heating zone, first burner means for supplying heat to said inner heating zone, second burner means for supplying heat to said outer heating zone, a pair of radiation shields being positioned adjacent said conduit means in said inner heating zone between said first burner means and said coiled pipe section and in said outer heating zone between said second burner means and said coiled pipe section respectively to lessen the radiant heat transferred to said coiled pipe section from said first and second burner means, said radiation shields being supported in said heating chamber in spaced relation to said conduit means, and said radiation shields forming a heat transfer barrier between the source of heat in said heating chamber and said conduit means to reduce the heat transferred to the conduit means for heating the medium.

2. In a heater the combination as set forth in claim 1 in which, said first pipe section and said second pipe section are formed by a plurality of connected helical coils positioned horizontally in overlying spaced relation.

3. In a heater the combination as set forth in claim 1 in which, said inner heating zone is positioned within said coiled pipe section and said outer heating zone is positioned outside said coiled pipe section, and said radiation shields having portions positioned in both said inner and outer heating zones to reduce the flame radiating temperature of said inner and outer heating zones.

4. In heater the combination as set forth in claim 1 which includes, a plurality of burners positioned in said heating chamber and mounted on said wall, each of said burners being located at a preselected elevation on said wall, said burners being mounted to direct combustion products tangentially relative to said conduit means into said heating chamber, and said radiation shield being positioned between said burners and said conduit means to limit the flame radiation to said conduit means.

5. In a heater the combination as set forth in claim 1 in which, said conduit means includes a pair of connected coiled pipe radiant sections spaced apart in said heating chamber, a coiled pipe convective section positioned between said radiant sections, said inlet being connected to one of said radiant sections and said outlet being connected to said convective section, said pair of radiant sections being connected to permit flow of the medium from said inlet through said radiant sections and said convective section to said outlet, and said radiation shield having portions positioned on both sides of said radiant sections to provide resistance to the radiant heat flow from said radiant sections to said conduit means.

6. In heater the combination as set forth in claim 5 which includes, an inner heating zone formed within each of said radiant sections and said convective section, an outer heating zone formed in an annular space between said wall and said radiant sections, first burner means for supplying heat to said inner heating zone of said radiant sections, and second burner means for supplying heat to said outer heating zone of said radiant sections.

7. In a heater the combination as set forth in claim 6 in which, said radiation shield portions are positioned in said inner and outer heating zones of said radiant sections, said radiation shield portions being positioned in said inner heating zone between said radiant sections and said first burner means, and said radiation shield portions being positioned in said outer heating zone between said radiant sections and said second burners means.

8. In a heater the combination as set forth in claim 6 in which, said second burner means includes a plurality of high velocity burners positioned at preselected elevations in said chamber, and said burners being mounted on said chamber wall to direct combustion products tangentially into said chamber to insure a uniform mixing of combustion products in said chamber.

9. In a heater the combination as set forth in claim 5 in which, said pair of coiled pipe radiant sections includes a first radiant section formed by a plurality of pipe coils connected in overlying spaced relation where each of said coils are of equal dimension and are operable to transfer a preselected degree of heat to the medium., and a second radiant section formed by a plurality of pipe coils connected in overlying spaced relation where each of said coils are of equal dimension and are operable to transfer to the medium a preselected degree of heat different from the degree of heat transferred by said first radiant section to the medium.

10. In a heater the combination as set forth in claim 1 in which, said radiation shield includes an outer shield portion positioned on one side of said conduit means and an inner shield portion positioned on the opposite side of said conduit means, said inner and outer shield portions being supported in said heating chamber to divide said heating chamber into an inner heating zone and an outer heating zone, and said inner and outer shield portions being operable as physical barriers in said inner and outer heating zones to provide different rates of heat transfer in said respective heating zones to the medium in said conduit means.

11. In a heater the combination as set forth in claim 1 which includes, means for supporting said conduit means in said heating chamber, support columns positioned externally of said heating chamber, and said means for supporting said conduit means extending through said heating chamber and secured to said support columns.

12. In a heater the combination as set forth in claim 1 in which, said heating chamber includes a floor and a roof with walls extending therebetween, said floor, roof, and walls being fabricated of a refractory material, and a housing surrounding said refractory walls, roof, and floor.

13. In a heater the combination as set forth in claim 1 in which, said radiation shields are perforated to a preselected size and pattern to modify the radiating characteristics to provide an increased rate of heat transfer from products of combustion in the heating chamber to said conduit means.

14. In a heater the combination as set forth in claim 1 in which, said radiation shield is fabricated of metal.

15. In a heater the combination as set forth in claim 1 in which, said radiation shield is fabricated of ceramic material.

16. In a heater the combination as set forth in claim 1 in which, said radiation shield is fabricated of a combination of metal and ceramic material.

17. A method of reducing the heat transfer to a medium in a heater comprising the steps of, heating a chamber of the heater to a preselected temperature, dividing the chamber into an inner heating zone and an outer heating zone by a coiled pipe section, conveying a medium for heating through conduit means positioned in the inner and outer hearing zones, maintaining the medium separated from the products of combustion in the chamber, shielding the conduit means from direct radiation of the products of combustion by positioning a radiation shield in the inner and outer heating zones adjacent the conduit means to lessen the radiant heat transferred to the conduit means, directing combustion products tangentially into the outer heating zone to provide uniform mixing of the combustion products, and maintaining different preselected firing rates and gas flue temperatures in the inner and outer heating zones to provide uniform heat transfer to the medium in the conduit means.

18. A method of reducing the heat transfer to a medium in a heater as set forth in claim 17 which includes, controlling the transfer of heat from the products of combustion to the conduit means by adjusting the fuel input rate to the chamber.

19. A method of reducing the heat transfer to a medium in a heater as set forth in claim 17 which includes, positioning a physical barrier adjacent to the conduit means between the source of radiant heat in the chamber and the conduit means to prevent the products of combustion from coming in direct contact with the conduit means.

* * * * *